US005183071A

United States Patent [19]

Ogawa

[11] Patent Number: 5,183,071

[45] Date of Patent: * Feb. 2, 1993

[54] COUNTERBALANCE VALVE

[75] Inventor: Kazunori Ogawa, Gifu, Japan

[73] Assignee: Teijin Seiki Co., Ltd., Osaka, Japan

[ * ] Notice: The portion of the term of this patent subsequent to Dec. 31, 2008 has been disclaimed.

[21] Appl. No.: 806,363

[22] Filed: Dec. 13, 1991

[30] Foreign Application Priority Data

Dec. 18, 1990 [JP] Japan ..... 2-411497

[51] Int. Cl.[5] ..... F15B 13/04

[52] U.S. Cl. ..... 137/106; 91/420; 91/436; 91/447

[58] Field of Search ..... 91/420, 436, 447; 137/106

[56] References Cited

U.S. PATENT DOCUMENTS 4,244,276 1/1981 Iwata .
4,763,691 8/1988 Hahmann .
5,076,143 12/1991 Ogawa ..... 91/420

FOREIGN PATENT DOCUMENTS 1929482 1/1970 Fed. Rep. of Germany .
54-44390 3/1979 Japan .
61-218803 9/1986 Japan .

*Primary Examiner*—Gerald A. Michalsky
*Attorney, Agent, or Firm*—Rothwell, Figg, Ernst & Kurz

[57] ABSTRACT

A counterbalance valve including a spool (62) divided into two spool pieces (63, 64) at its axial center, return springs (71, 72) for urging the spool pieces inwardly along the axial direction toward their innermost positions, a first passage (90) for introducing an inside pressure in a supply and exhaust passage (48) to an outermost end of the spool piece (63), a second passage (91) for introducing an inside pressure in the supply and exhaust passage (49) to an outermost end of the spool piece (64), a pressure selecting member (88) for selecting higher inside pressure among the inside pressures in the supply and exhaust passages (48, 49) and for introducing the selected pressure via a choke (87) to a pressure chamber (73) formed between the spool pieces (63, 64), and a communicating passage (95) formed for communicating the supply and exhaust passages (48, 49) with each other when both the spool pieces (63, 64) are moved outwardly in the axial direction from the innermost positions due to fluid in the pressure chamber (73).

1 Claim, 3 Drawing Sheets

FIG. 1-a
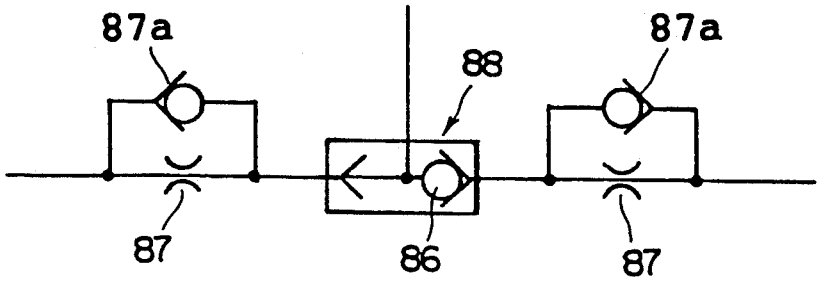
FIG. 1-b
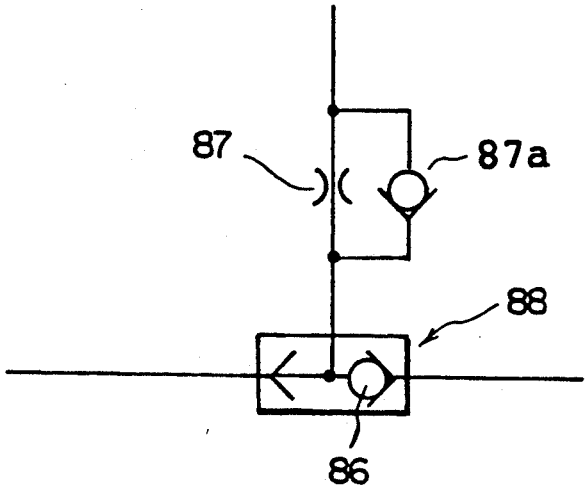

COUNTERBALANCE VALVE

FIELD OF THE INVENTION

The present invention relates to a counterbalance valve provided with a spool which is divided into two spool pieces at the center in an axial direction thereof.

Conventionally, a counterbalance valve for preventing cavitation in a supply and exhaust passage at the intake side has been known, for example, from the disclosure in Japanese Patent Application Laid-open No. Sho 61-218803. In this device, as illustrated in FIG. 2, a spool 11 is divided into two spool pieces 12 and 13 at the center in an axial direction thereof, and return springs 14 and 15 are disposed for urging the spool pieces 12 and 13 inwardly along the axial direction toward their innermost positions. A first passage 20 is formed for introducing an inside pressure in one of supply and exhaust passages 18 to an outermost end in the axial direction of one of the spool pieces 12. Similarly, a second passage 21 is formed for introducing an inside pressure in the other supply and exhaust passage 19 to an outermost end in the axial direction of the other spool piece 13. Further a pressure selecting means 24 is formed for selecting higher inside pressure among the inside pressures in the supply and exhaust passages 18 and 19 and for introducing the selected pressure via a choke 23 to a pressure chamber 22 formed between the spool pieces 12 and 13.

Such a counterbalance valve 25 is usually disposed within a fluid circuit 26, for example, in a pair of supply and exhaust passages 18 and 19, which communicates an actuator 28 for driving a crawler vehicle with a directional control valve 29.

Such a fluid circuit 26 operates as follows. More specifically, for example, when the directional control valve 29 is positioned at one of the flow positions, fluid with a high pressure flows into one of the supply and exhaust passages 18 and operates the actuator 28. Thereafter, the fluid is exhausted from the actuator 28 into the other supply and exhaust passage 19 as fluid with a low pressure.

In this occasion, the high pressure in the supply and exhaust passage 18 is selected and introduced by the pressure selecting means 24 to the innermost end in an axial direction of the spool piece 12, i.e., to the pressure chamber 22, and the high pressure in the supply and exhaust passage 18 is introduced to the outermost end in the axial direction of the spool piece 12 through the first passage 20. Accordingly, the spool piece 12 remains at its innermost position.

Contrary to this, though the high pressure is selected and introduced to the innermost end in an axial direction of the spool piece 13, i.e., to the pressure chamber 22, in a foregoing manner, the low pressure in the other supply and exhaust passage 19 is introduced to the outermost end in the axial direction of the spool piece 13 through the second passage 21. Accordingly, only the other spool piece 12 moves outwardly in the axial direction. As a result, the other spool piece 13 opens, and the fluid with a low pressure flows into the other supply and exhaust passage 19 without being prevented by the counterbalance valve 25.

Then, when the directional control valve is turned from the above-mentioned flow position to a neutral position, the other spool piece 13 is urged by the return spring 15 and moves so as to return to its innermost position, since the pressure in both the supply and exhaust passages 18 and 19 and the pressure chamber 22 becomes low.

Contrary to this, since the actuator 28 continues to operate by its inertia for a short time just after the directional control valve 29 is turned to the neutral position, it sucks fluid through the supply and exhaust passage at the intake side, i.e., the supply and exhaust passage 18 in this instance. In this case, the actuator 28 is supplemented with fluid from the supply and exhaust passage 18 through a check valve 31.

However, in such a conventional counterbalance valve 25 as described above, since the amount of fluid supplemented from the supply and exhaust passage of the actuator 28 at the intake side is insufficient, cavitation may occur in the supply and exhaust passages at the intake side, and accordingly, there are problems that a large noise is generated or that the actuator 28 is damaged. The reasons for such problems are as follows. Although the counterbalance valve 25 is usually disposed very adjacent to the actuator 28, the directional control valve 29 is disposed at a position, for example, at the operator,s seat, which is far away from the actuator 28. Consequently, the length of the passage from the actuator 28 to the directional control valve 29 is very long. As a result, fluid is subjected to a large resistance while it flows from the directional control valve 29 to the actuator 28. There is a tendency that such cavitation as described above occurs most when the actuator 28 is operating at the highest speed just after the directional control valve 29 is turned to the neutral position.

OBJECT OF THE INVENTION

It is an object of the present invention to provide a counterbalance valve which can effectively prevent cavitation from occurring in a supply and exhaust passage at the intake side when a directional control valve is turned to its neutral position, and accordingly, which prevents noise and damage of the actuator from occurrence.

SUMMARY OF THE INVENTION

According to the present invention, the above-described object is achieved by a counterbalance valve comprising a spool which is divided into two spool pieces at the center in an axial direction thereof, return springs for urging the spool pieces inwardly along the axial direction toward their innermost positions, a first passage for introducing an inside pressure in one of supply and exhaust passages to an outermost end in the axial direction of one of the spool pieces, a second passage for introducing an inside pressure in the other supply and exhaust passage to an outermost end in the axial direction of the other spool piece, and a pressure selecting means for selecting higher inside pressure among the inside pressures in the supply and exhaust passages and for introducing the selected pressure via a choke to a pressure chamber formed between the spool pieces, characterized in that a communicating passage is formed for communicating the supply and exhaust passages with each other when both the spool pieces are moved outwardly in the axial direction from the innermost positions due to fluid in the pressure chamber.

When the directional control valve is turned from a flow position to a neutral position while the actuator is operating, the actuator continues to operate for a short time due to its inertia. As a result, the actuator tends to suck fluid from the supply and exhaust passage at the intake side.

In this occasion, as described above, both the spool pieces are movign outwardly in the axial direction from their innermost positions, respectively, due to the fluid remaining in the pressure chamber. Thus, both the supply and exhaust passages communicate with each otehr through the communicating passage, and fluid is supplemented from the supply and exhaust passage at exhaust side to the supply and exhaust passage at the intake side.

Here, since the distance from the actuator to the counterbalance valve is remarkably shorter than the distance from the actuator to the directional control valve, the fluid receives very small resistance from the passage during supplementation. As a result, the supply and exhaust passage at the intake side is supplemented with a sufficient amount of fluid, and cavitation is surely prevented from occurrence. Thus, such risks as generation of large noise or damage of the actuator are also minimized or avoided. In this occasion, since fluid is flowed out without substantial resistance from the supply and exhaust passage at the exhaust side to the supply and exhaust passage at the intake side, surge pressure, which may occur in the supply and exhaust passage at the exhaust side in the conventional device, can be surely prevented from occurring.

Further, since the operations described above can be achieved only by forming the communicating passage in an already existing counterbalance valve, the counterbalance valve of the present invention is simple in construction and is easy to manufacture.

BRIEF DESCRIPTION OF THE DRAWINGS

Some embodiments of the present invention will now be described in detail with reference to the accompanying drawings, wherein:

FIG. 1-*a* is a diagram partially showing another embodiment of the present invention;

FIG. 1-*b* is a diagram partially showing still another embodiment of the present invention.

PREFERRED EMBODIMENTS

Figure 1:
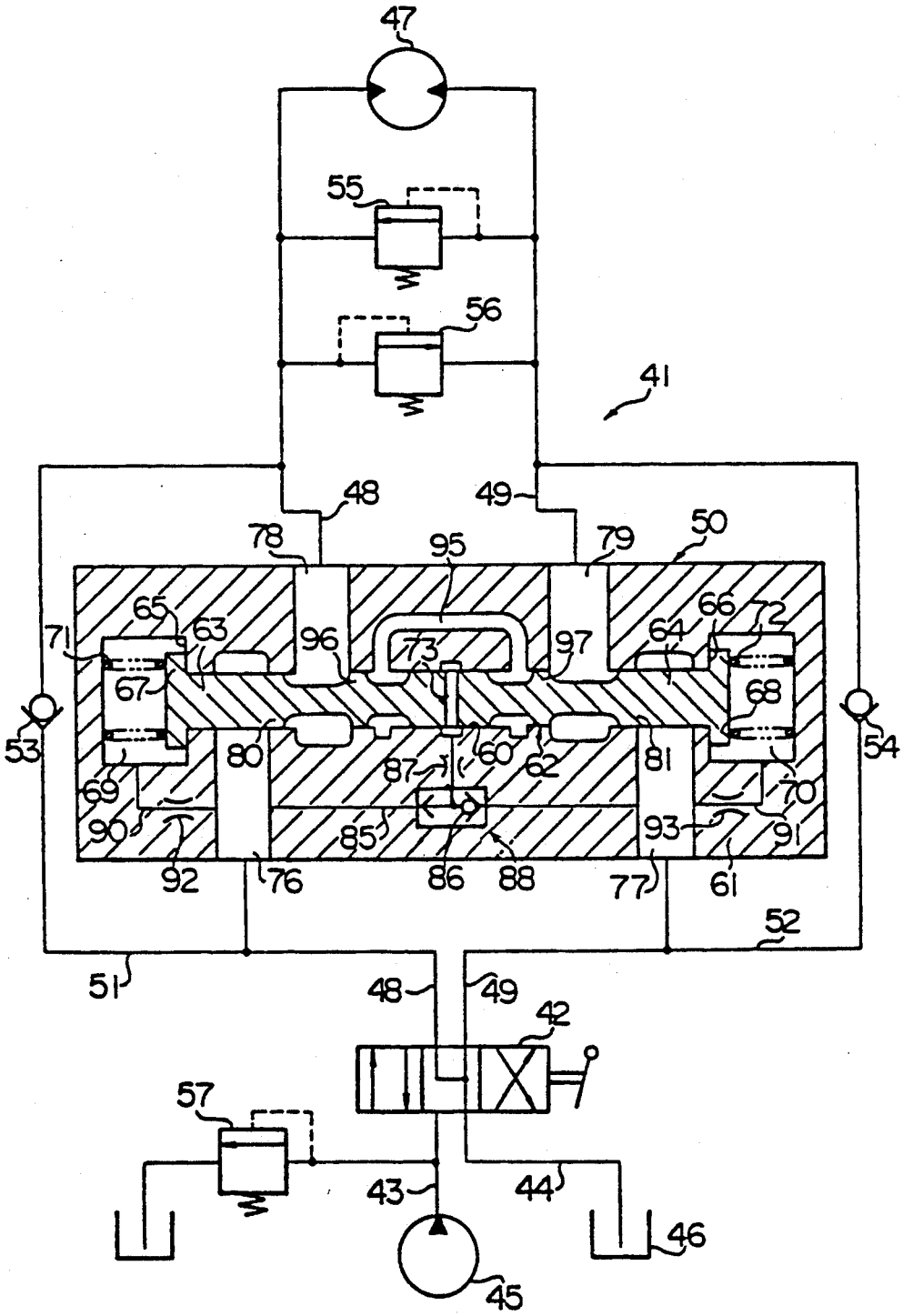
FIG. 1 is a sectional view of an embodiment of the present invention, a part of which is illustrated by symbols.
Figure 2:
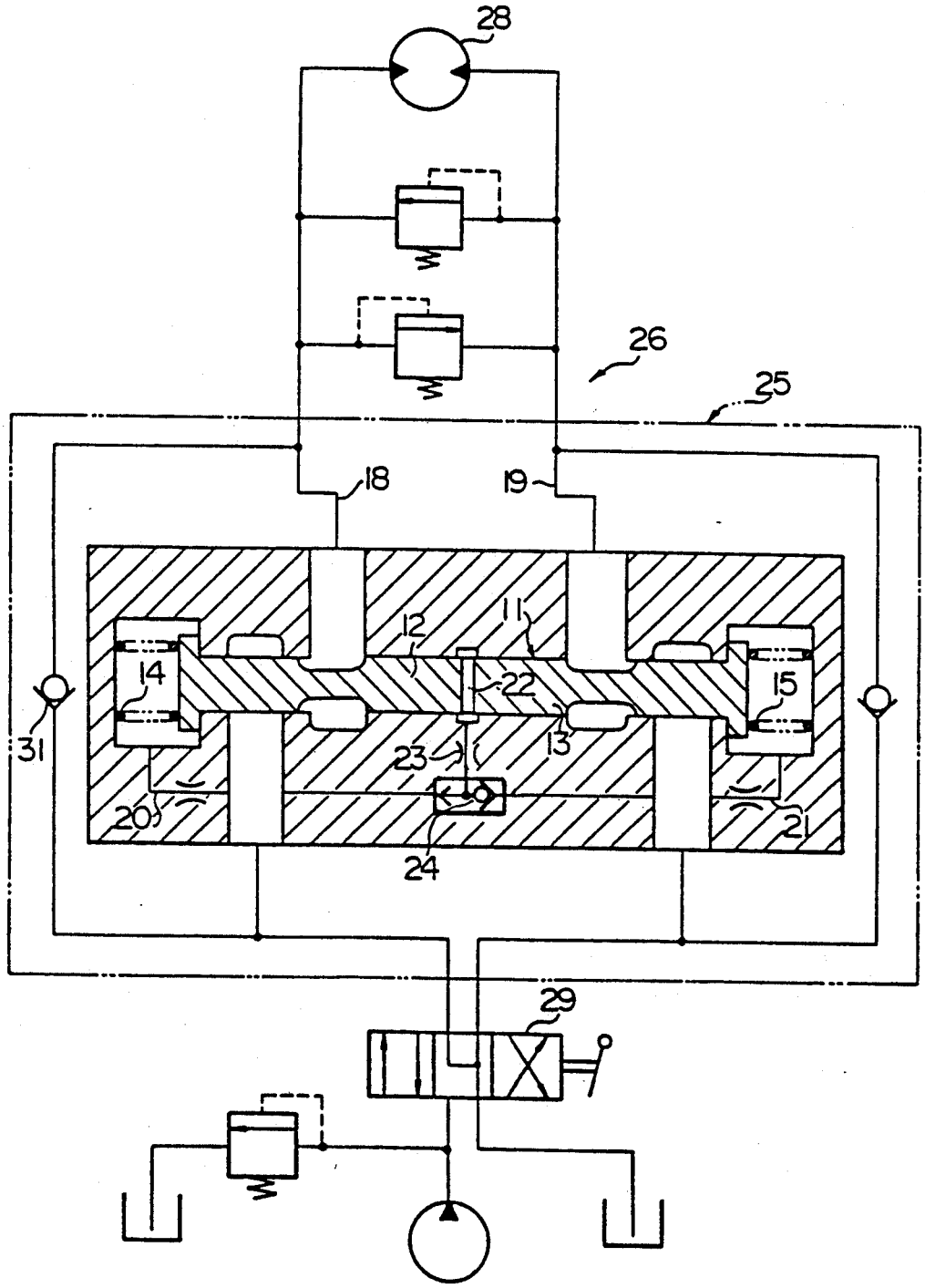
FIG. 2 is a sectional view of a conventional counterbalance valve, a part of which is illustrated by symbols.

In FIG. 1, reference numeral 41 denotes a fluid circuit for driving a crawler vehicle, and the fluid circuit 41 includes a fluid pump 45 and a tank 46. The pump 45 and the tank 46 are communicated with a directional control valve 42, which is disposed at the operator's seat, through passages 43 and 44. The directional control valve 42 and a hydraulic motor 47, which operates as an actuator, are communicated with each other via a pair of supply and exhaust passages 48 and 49, and a counterbalance valve 50 is disposed in the supply and exhaust passages 48 and 49.

In this occasion, the length of the supply and exhaust passages 48 and 49 from the hydraulic motor 47 to the counterbalance valve 50 is short, while the length of the supply and exhaust passages 48 and 49 from the counterbalance valve 50 to the directional control valve 42 is long.

Reference numerals 51 and 52 denote passages for by-passing the counterbalance valve 50, ends of which passages are connected to the supply and exhaust passages 48 and 49, respectively, and the passages 51 and 52 have check valves 53 and 54 disposed therein, respectively, which only allow flow from the directional control valve 42 to the hydraulic motor 47. Reference numerals 55 and 56 denote relief valves.

The counterbalance valve 50 comprises a casing 61, which has a spool chamber 60 formed therein, and a spool 62 is slidably accommodated within the spool chamber 60. The spool 62 is divided into two spool pieces 63 and 64 at the center in an axial direction, and the spool pieces 63 and 64 have flanges 67 and 68, respectively, at the outermost ends thereof in the axial direction, which flanges can abut with shoulders 65 and 66 of the casing 61, respectively.

Spring chambers 69 and 70 are formed outside the spool pieces 63 and 64 in the axial direction, and return springs 71 and 72 are accommodated in the spring chambers 69 and 70, respectively, for urging the spool pieces 63 and 64 toward their innermost positions in the axial direction. When the flanges 67 and 68 abuts the shoulders 65 and 66, respectively, after. the spool pieces 63 and 64 are moved toward their innermost positions by the return springs 71 and 72, their movement in the axial direction is limited and they stop at their innermost positions. As a result, the spool pieces 63 and 64 can move outwardly in the axial direction from their innermost positions. Further, a pressure chamber 73 is formed between the inner ends, which are facing each other, of the spool pieces 63 and 64.

Reference numerals 76 and 77 denote a pair of first fluid passages formed in the casing 61, and ends of the first fluid passage 76 and 77 are connected to the supply and exhaust passages 48 and 49 near the directional control valve 42, and the other ends of the first fluid passage 76 and 77 open into the spool chamber 60.

Reference numerals 78 and 79 denote a pair of second fluid passages formed in the casing 61, and ends of the second fluid passage 78 and 79 are connected to the supply and exhaust passages 48 and 49 near the hydraulic motor 47, and the other ends of the second fluid passage 78 and 79 open into the spool chamber 60 at positions axially inner than positions where the first fluid passages 76 and 77 open.

When the spool pieces 63 and 64 are at their innermost positions, respectively, communication between the first and second passages 76 and 78 and communication between the first and second passages 77 and 79 are shut by lands 80 and 81 of the spool pieces 63 and 64. Contrary to this, when the spool pieces 63 and 64 move outwardly in the axial direction from their innermost positions, the first passage 76 and the second passage 78 are also communicated with each other, and the first passage 77 and the second passage 79 are communicated with each other.

Reference numeral 85 denotes a selecting passage having ends branched into two which ends are communicated with the first fluid passages 76 and 77, respectively, and the other end of the selecting passage 85 opens at the center in the axial direction of the spool chamber 60. A check valve 86 is disposed at the branched portion of the selecting passage 5 so as to allow only flow of fluid from the former ends of the selecting passage 85 to the other end of the selecting passage 85. As a result, the higher inner pressure in the supply and exhaust passages 48 and 49 is selected by the check valve 86 and is taken up, and then it is introduced into pressure chamber 73 so that the spool pieces 63 and 64 are subjected to fluid force which outwardly urges the spool pieces 63 and 64 in the axial direction.

Reference numeral 87 denotes a choke which is disposed at the other end of the selecting passage 85. A pair of chokes may be disposed at both the sides of the pressure selecting means 88 as illustrated in FIG. 1-*a*. Further, it is preferred that the choke 87 is accompanied with a check valve 87*a* disposed in parallel therewith as illustrated in FIGS. 1-*a* and 1-*b*.

The selecting passage 85 and the check valve 86, which have been described above, as a whole, constitute a pressure selecting means 88 of the present invention for selecting higher inside pressure among the inside pressures in the supply and exhaust passages 48 and 49 and for introducing the selected pressure via a choke 87 to the pressure chamber 73. The spring chambers 69 and 70 and the first fluid passages 76 and 77 are always communicated with each other through the first and second passages 90 and 91 which are formed in the casing 61 and which have chokes 92 and 93 disposed therein. As a result, the inner pressures in the supply and exhaust passages 48 and 49 are introduced to the outside ends of the spool pieces 62 and 63 through the first and second passages 90 and 91, respectively.

Reference numeral 95 denotes a communicating passage which is formed in the casing 61, and ends of the communicating passage 95 open at two positions in the spool chamber 60, which positions locate between the second fluid passages 78 and 79 and the center in the axial direction, respectively. The fluid passage 95 is shut from the second fluid passages 78 and 79 by means of the lands 96 and 97 of the spool pieces 63 and 64 when the spool pieces 63 and 64 are kept at their innermost positions. However, when the spool pieces 63 and 64 outwardly move in the axial direction from their innermost positions for a predetermined distance, the communicating passage 95 communicates with the second fluid passages 78 and 79, i.e., the supply and exhaust passages 48 and 49, and accordingly, the supply and exhaust passages 48 and 49 are communicated with each other.

The operation of the embodiment of the present invention will now be described. When the directional control valve 42 is turned from the flow position to the neutral position while the hydraulic motor 47 is rotating, the hydraulic motor 47 continues to rotate for a short time due to its inertia. As a result, the hydraulic motor 47 tends to suck fluid from the supply and exhaust passage 48 at the intake side, for example, from the fluid passage 48. At this moment, since both the spool pieces 63 and 64 have been moved outwardly for at least the predetermined distance in the axial direction from their innermost positions by the fluid remaining in the pressure chamber 73 as described above, the supply and exhaust passages 48 and 49 are communicated with each other through the communicating passage 95, and the supply and exhaust passage 49 at the intake side is supplemented with fluid from the supply and exhaust passage at the exhaust side. In this case, since the distance from the hydraulic motor 47 to the counterbalance valve 50 is remarkably shorter than that from the hydraulic motor 47 to the directional control valve 42, resistance in the passage upon supplementation is negligible. As a result, the supply and exhaust passage 48 at the intake side, and accordingly, the hydraulic motor 47 is supplied with a sufficient amount of fluid, and thus occurrence of cavitation is surely prevented. Thus, generation of large noise and damage of the hydraulic motor 47 are avoided. In this instance, since the fluid flows out from the supply and exhaust passage 49 at the exhaust side to the supply and exhaust passage 48 at the intake side through the communicating passage 95, fluid is subjected to very small resistance. As a result, the generation of surge pressure, which may occur in the supply and exhaust passage 49 in the conventional device, can also be surely prevented. The foregoing operation can be expected when the intake side is the supply and exhaust passage 49, while the exhaust side is the supply and exhaust passage 48.

The present invention can be applied to a fluid circuit, for example, a circuit for driving a winch, wherein a part of the circuit is always a supply and exhaust passage at the intake side and the other part of the circuit is always a supply and exhaust passage at the exhaust side.

As described above, the present invention can readily and easily prevent cavitation, which may be generated in the supply and exhaust passage at the intake side in the conventional device when the directional valve is turned from the flow position to the neutral position, from occurrence.

I claim:

1. A counterbalance valve comprising a spool which is divided into two spool pieces at the center in an axial direction thereof, return springs for urging the spool pieces inwardly along the axial direction toward innermost positions, a first passage for introducing an inside pressure in a supply and exhaust passage to an outermost end in the axial direction of one of the spool pieces, a second passage for introducing an inside pressure in another supply and exhaust passage to an outermost end in the axial direction of the other spool piece, a pressure selecting means for selecting higher inside pressure among the inside pressures in the supply and exhaust passages and for introducing the selected pressure to a pressure chamber formed between the spool pieces, and a communication passage means for communicating the supply and exhaust passages with each other when both the spool pieces are moved outwardly in the axial direction from the innermost positions due to fluid in the pressure chamber.

* * * * *

UNITED STATES PATENT AND TRADEMARK OFFICE

CERTIFICATE OF CORRECTION

PATENT NO. : 5,183,071

DATED : February 2, 1993

INVENTOR(S) : Kazunori OGAWA

It is certified that error appears in the above-identified patent and that said Letters Patent is hereby corrected as shown below:

Col. 2, line 23, "operator,s" should be --operator's--.

Col. 3, line 7, "otehr" should be --other--.

Col. 4, line 60, "5" should be --85--.

Signed and Sealed this

Eleventh Day of January, 1994

Bruce Lehman

*Attest:*

BRUCE LEHMAN

*Attesting Officer*

*Commissioner of Patents and Trademarks*